US006821234B1

(12) United States Patent
Barbee

(10) Patent No.: US 6,821,234 B1
(45) Date of Patent: Nov. 23, 2004

(54) MOTORIZED EXERCISE AND REHABILITATION CHAIR

(76) Inventor: Raymond L. Barbee, 2690 Piney Grove Church Rd., Kenly, NC (US) 27542

( * ) Notice: Subject to any disclaimer, the term of this patent is extended or adjusted under 35 U.S.C. 154(b) by 0 days.

(21) Appl. No.: 10/690,089

(22) Filed: Oct. 21, 2003

(51) Int. Cl.[7] ..... A63B 22/00; A61H 1/00

(52) U.S. Cl. ..... 482/57; 482/62; 601/33; 601/23

(58) Field of Search ..... 482/7, 51–53, 482/57–65, 79–80; 601/5, 33, 23–27, 92–93

(56) References Cited

U.S. PATENT DOCUMENTS 3,419,001 A * 12/1968 Woods ..... 601/26
3,774,597 A * 11/1973 Root ..... 601/27
4,402,502 A * 9/1983 Peters ..... 601/36
4,862,875 A * 9/1989 Heaton ..... 601/26
5,417,643 A * 5/1995 Taylor ..... 601/33
5,419,752 A * 5/1995 James et al. ..... 601/5
5,595,557 A * 1/1997 Lambert et al. ..... 482/57
6,220,991 B1 * 4/2001 Sellers ..... 482/62

* cited by examiner

*Primary Examiner*—Steve R. Crow
(74) *Attorney, Agent, or Firm*—Mills Law Firm PLLC

(57) ABSTRACT

A motorized exercise and rehabilitation chair for pacing controlled movements of the legs and arms of a disabled user includes a chair supported above a reciprocating platform having a frontal spring biased footrest for exercising the knee and ankle joints and armrest that orbit in a circular pattern for exercising the elbow and shoulder joints of the user. The user may select and vary the operating speeds of the platform and armrests from a control unit swivel mounted in front of the chair.

10 Claims, 8 Drawing Sheets

MOTORIZED EXERCISE AND REHABILITATION CHAIR

FIELD OF THE INVENTION

The present invention relates to exercise and rehabilitation equipment, and, in particular, to a motorized chair for exercising and rehabilitating persons with physical disabilities.

BACKGROUND OF THE INVENTION

Regular exercise regimens are important in the mediation and rehabilitation of people experiencing disabilities as a result of medical conditions or trauma. Typically, the programs are conducted by physical therapists, skilled in the techniques for restoring movement and strength capability. Inasmuch as these services are expensive and time limited, various approaches have been disclosed in the art for allowing a disabled person, without the direct aid of a therapist, to undertake machine paced movements, in the home or at a medical facility.

Many dedicated rehabilitation devices have focused on discrete extremity disabilities. In U.S. Pat. No. 3,316,898 to Brown, reciprocating and inclining steps are provided for exercising the lower limbs. The patient, however, must be able to stand on the apparatus and safely maintain balance during operation, oftentimes not possible in view of their medical condition or physical limitation. Other dedicated equipment such a disclosed in U.S. Pat. No. 4,862,875 to Heaton allow the paced flexing of the ankles and toes while seated. U.S. Pat. No. 3,419,001 to Woods and U.S. Pat. No. 3,774,597 to Root disclose reciprocating members for exercising the feet from a seated position. Still other chair based equipment have provided pedal sets for replicating bicycling activity as disclosed in U.S. Pat. No. 6,368,280 to Crewe. Further, devices for pacing arm movements from a seated position are disclosed in U.S. Pat. No. 5,417,643 to Taylor.

While providing passive motion means for discrete limbs, the foregoing devices are not well suited for the general disabled population having disabilities affecting both upper and lower body limbs, such as stroke and paralyzed patients. A muscle exercise apparatus for the physically disabled for jointly exercising the lower body and upper body is disclosed in U.S. Pat. No. 5,419,752 wherein the arms and legs are moved in phase opposition. The equipment requires severe movement patterns that may be beyond the capabilities of many patients. Another seated exercising device is disclosed in U.S. Pat. No. 2,850,841 to Martinez. The device is exceedingly large and complicated, limiting usage. Further, only simple reciprocating motions are provided, limiting the exercise of many deficient joints such as shoulders, ankles and elbows.

BRIEF SUMMARY OF THE INVENTION

In view of the above limitations of the prior art, the present invention provides a motorized rehabilitation chair that permits selective use of systems for separately exercising the upper and lower body, and provides for comprehensive and adjustable articulation of all the limbs. The exercise chair includes a lower body exercise system that reciprocates the lower limbs and provides for exercise of the knees and ankles. An upper body exercise system is provided that orbits the user's forearm for exercising of the shoulders and arms. The chair is provided with controls for independently actuating the systems and controlling their speed. The systems are also adjustable for altering the characteristics and demands of the paced movement path.

Accordingly, it is an object of the present invention to provide a chair based exercise system selectively electing and pacing an exercise regimen for their involved limbs.

Another object is to provide a rehabilitation chair having a selective movement pattern for the lower limbs that exercises and flexes the knee and ankle joints.

A further object is to provide a rehabilitation chair having orbiting arm rests for reciprocating and elevating the forearms for exercising shoulder and arm joints.

DESCRIPTION OF THE DRAWINGS

The above and other objects and advantages of the present invention will become apparent upon reading the following detailed description, taken in conjunction with the accompanying drawings in which.

DETAILED DESCRIPTION OF THE PREFERRED EMBODIMENT

Figure 1:
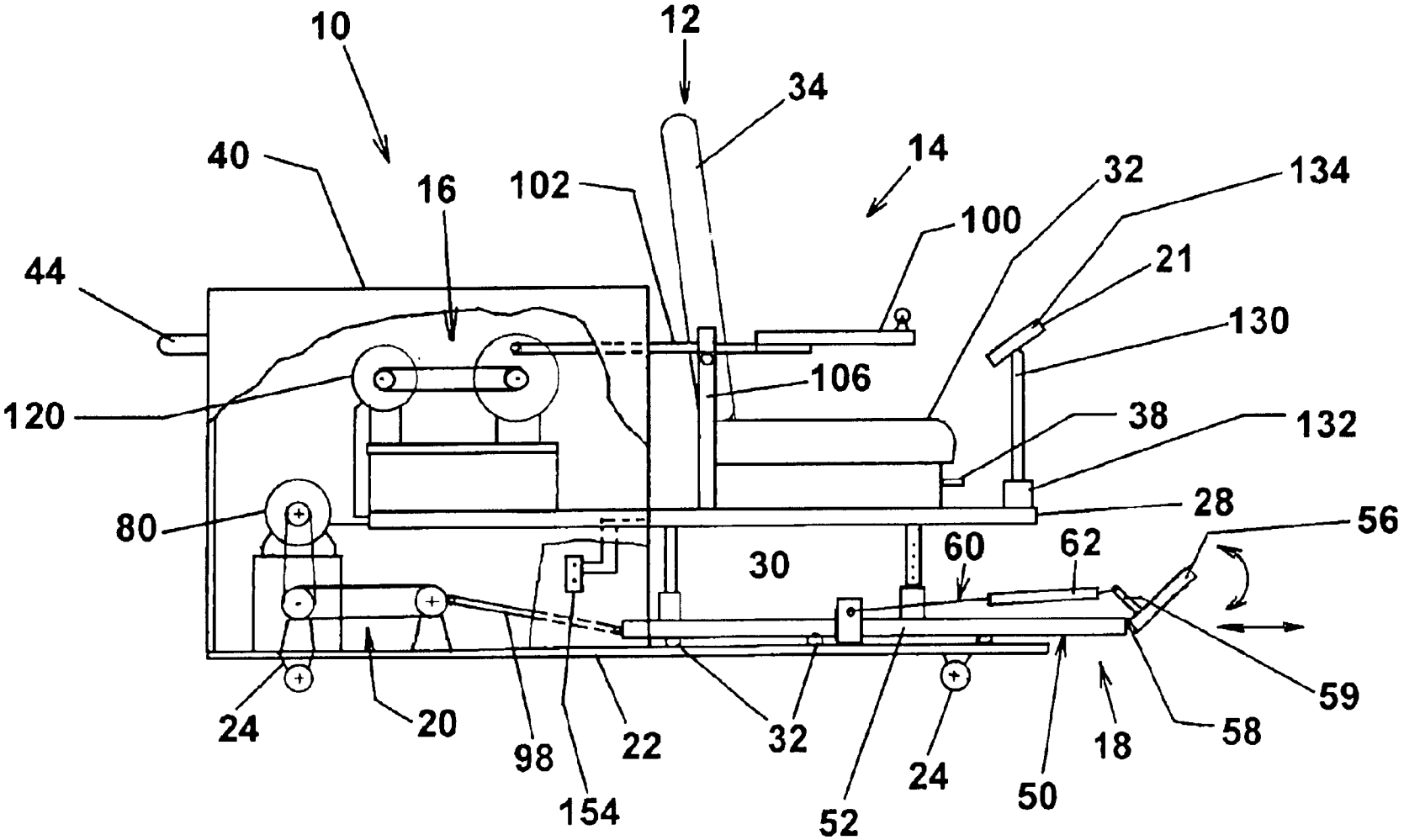
FIG. 1 is a side view of a motorized rehabilitation chair according to a preferred embodiment.
Figure 2:
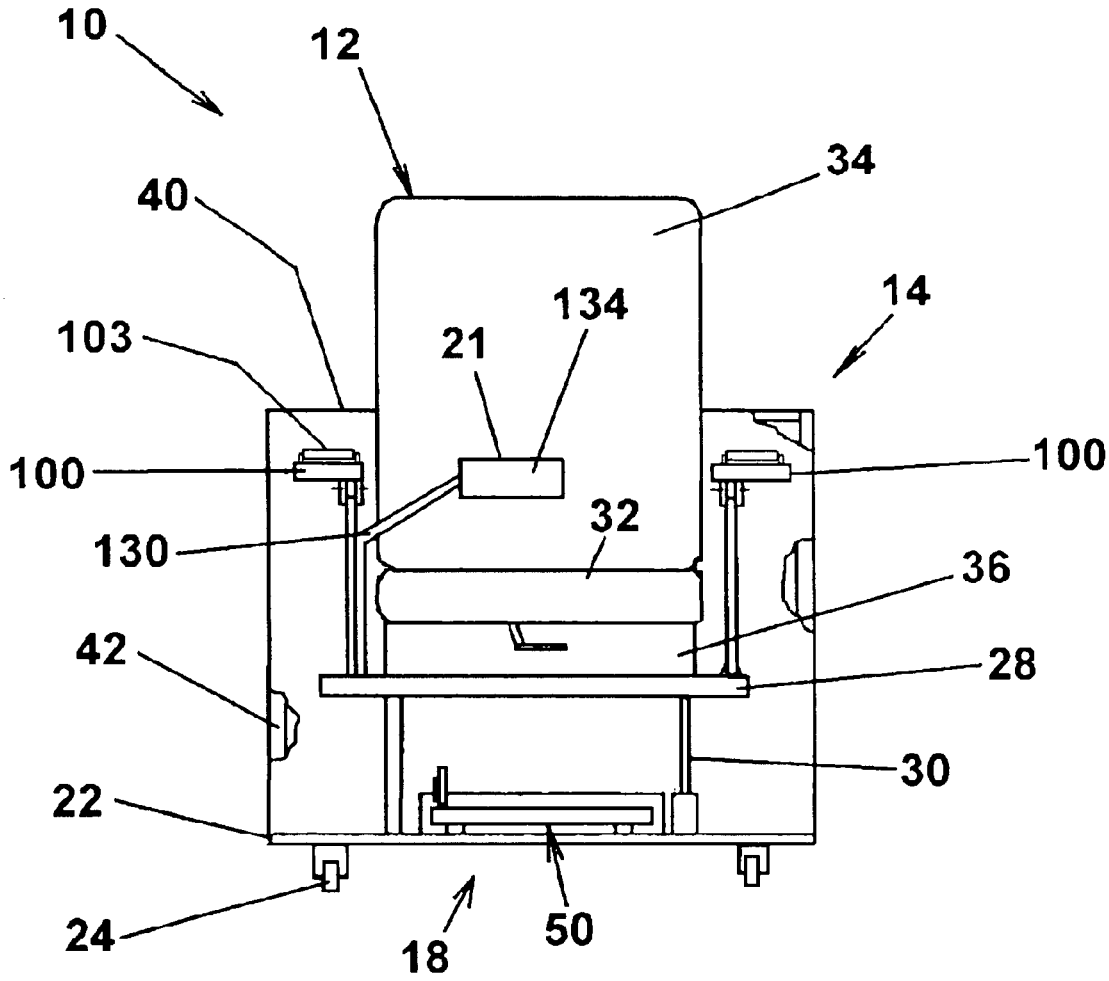
FIG. 2 is a front view of the chair of FIG. 1.

Referring to the drawings for the purpose of illustrating a preferred embodiment of the invention and not for limiting same, FIG. 1 shows a motorized exercise and rehabilitation chair 10 for use by persons in undertaking maintenance and restorative exercising of impaired upper and lower body functions. The chair 10 comprises a seat 12 having an upper body exerciser 14 operated through an upper drive system 16 and a lower body exerciser 18 operated through a lower drive system 20. A control unit 21 operated by the chair user selectively actuates and regulates the systems 16 and 20.

The chair 10 includes a horizontal base frame 22 having wheel assemblies 24 for rolling movement along a floor 26. The seat 12 is mounted on a horizontal seat frame 28 adjustably vertically supported on the base frame 22 by support legs 30. The seat 12 includes a base cushion 32 and a seat back 34. The seat 12 is supported on a longitudinally adjustable slide assembly 36 operated by control lever 38. A suitable seat for use in the present invention is a bolstered automobile seat together with a conventional adjustable mechanism for fore and aft positioning. The support legs 30 include a base sleeve attached to the base frame telescopically carrying a support bar attached to the seat frame 28. The support bar includes a plurality of vertically spaced cross holes for receiving a cross pin to adjust the height of the seat.

A housing 40 is carried on the base frame rearwardly of the seat and includes removable side and top panels supported on framework 42 for enclosing drive assemblies 16 and 20. A handle 44 is provided at the rear of the housing 40 for maneuvering the chair 10 about the floor 26 to a desired exercise location.

The lower body exerciser 18 comprises a generally rectangular horizontal foot platform 50 that is slidably supported by roller assemblies 52 on the base frame 22 for forward and rearward reciprocation below the seat cushion 32. A foot platform 50 includes a main panel 54 and a footrest 56 hinged to the front thereof for pivotal movement about a about a transverse axis 58. The footrest 56 is pivoted at the end of the forward movement of the platform 50 between a lowered horizontal position aligned with the main panel and the illustrated upwardly inclined position. The footrest 56 includes an upwardly extending lever arm 59. A flexible linkage 60 including spring 62 is connected between the upper end of the lever arm 58 and a bracket 64 attached to the side of the base frame 22. As the platform 50 moves toward the forward positioned the linkage 60 is tensioned and rotates the lever arm 59 and the footrest 56 to the inclined position under the elastic resistance of the spring 62. In the rearward positions the linkage is relaxed and rests at the side of the base frame 22.

Figure 3:
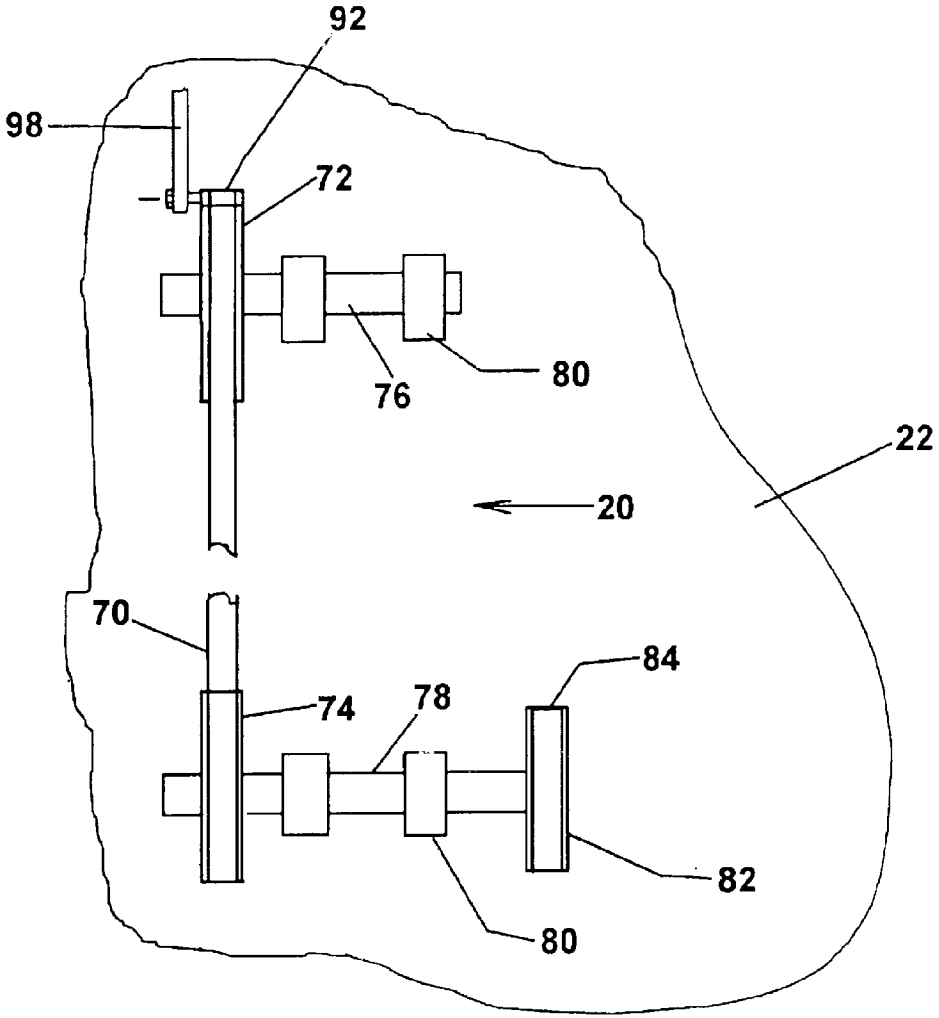
FIG. 3 is a fragmentary top view of the lower drive system for the chair.
Figure 4:
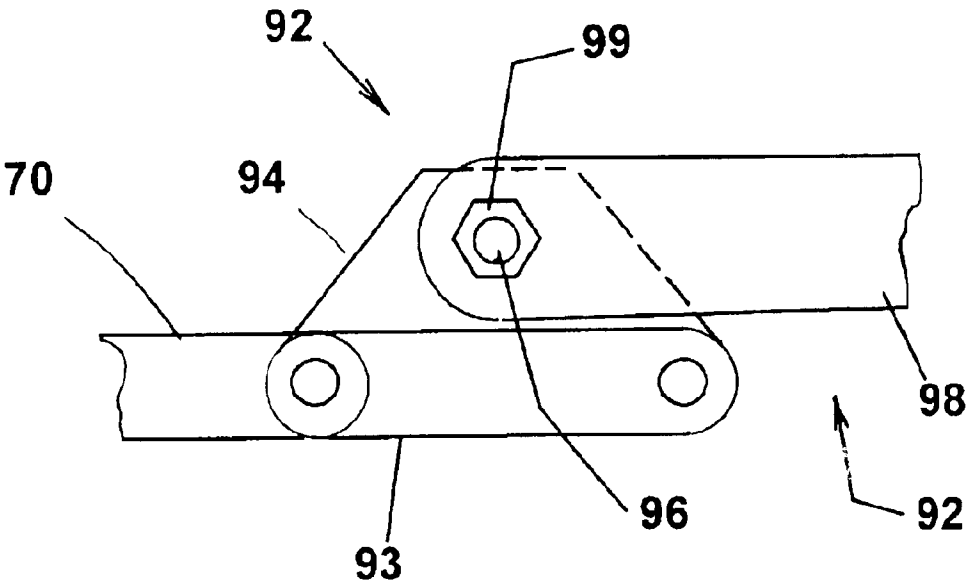
FIG. 4 is a fragmentary side view of the connection of the drive bar to the drive chain for the lower drive system.
Figure 11:
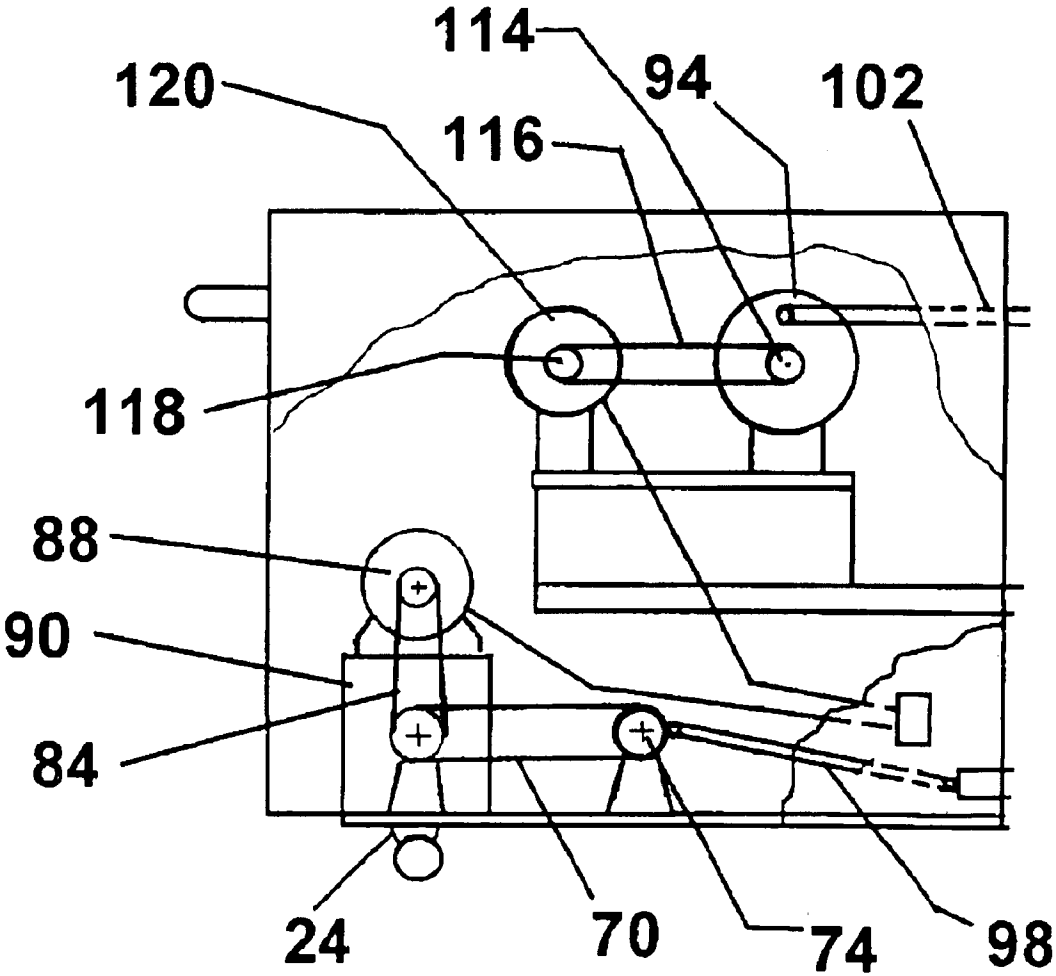
FIG. 11 is an enlarge side view of the housing for the chair illustrating the upper and lower drive systems.

Referring to FIG. 11, the platform 50 is moved between the forward and rearward positions by lower drive system 20. The drive system 20 comprises a drive chain 70, in belt or link form, connected with longitudinally spaced drive wheels 72 and 74. As shown in FIG. 3 the drive wheels 72, 74 are carried on transverse front and rear shaft, 76 and 78 respectively, rotatably supported by bearing assemblies 80 mounted on the base frame 22. A drive wheel 82 mounted on the rear shaft 78 is connected by drive chain 84 to the output wheel 86 on a variable speed electric lower drive motor 88 mounted on the base frame 22 by support 90.

Figure 5:
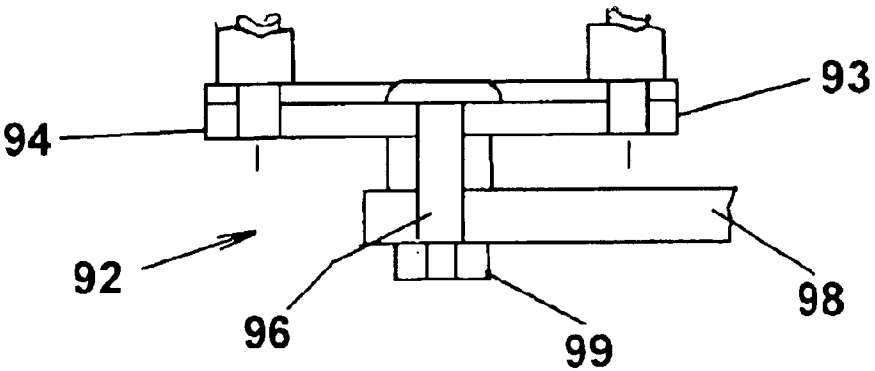
FIG. 5 is a fragmentary top view of the connection of the drive bar to the drive chain for the lower drive system as shown in FIG. 4.
Figure 6:
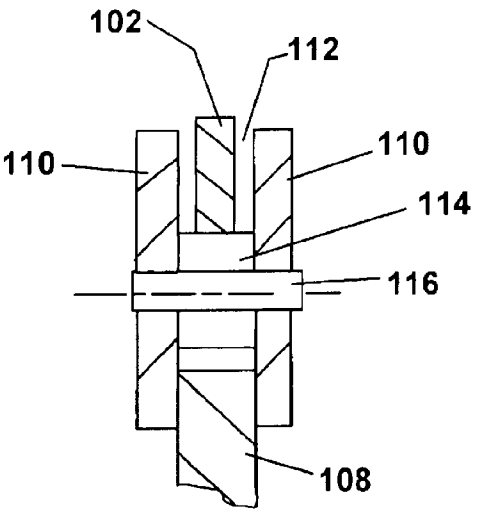
FIG. 6 is a fragmentary cross sectional view of the center support roller for the drive bar for the upper body system.

Referring to FIGS. 5 and 6, a connector assembly 92 is attached to one link 93 of the drive chain 70. The connector assembly 92 includes a drive plate 94 connected at the pins of the link 93. A drive pin 96 is attached to the drive plate 94 and projects transversely outwardly therefrom. A drive bar 98 is pivotally connected at a rear end to the drive pin 96 and at the front end to the rear of the foot platform. The drive bar 98 is fixed to the connector assembly by fastener 99. Accordingly, the connector assembly 92 rotates with the drive chain 70 and reciprocates the drive bar 98 thereby reciprocating the foot platform 50 between the rearward and forward positions. A dwell period is provided at the ends of the stroke.

Figure 9:
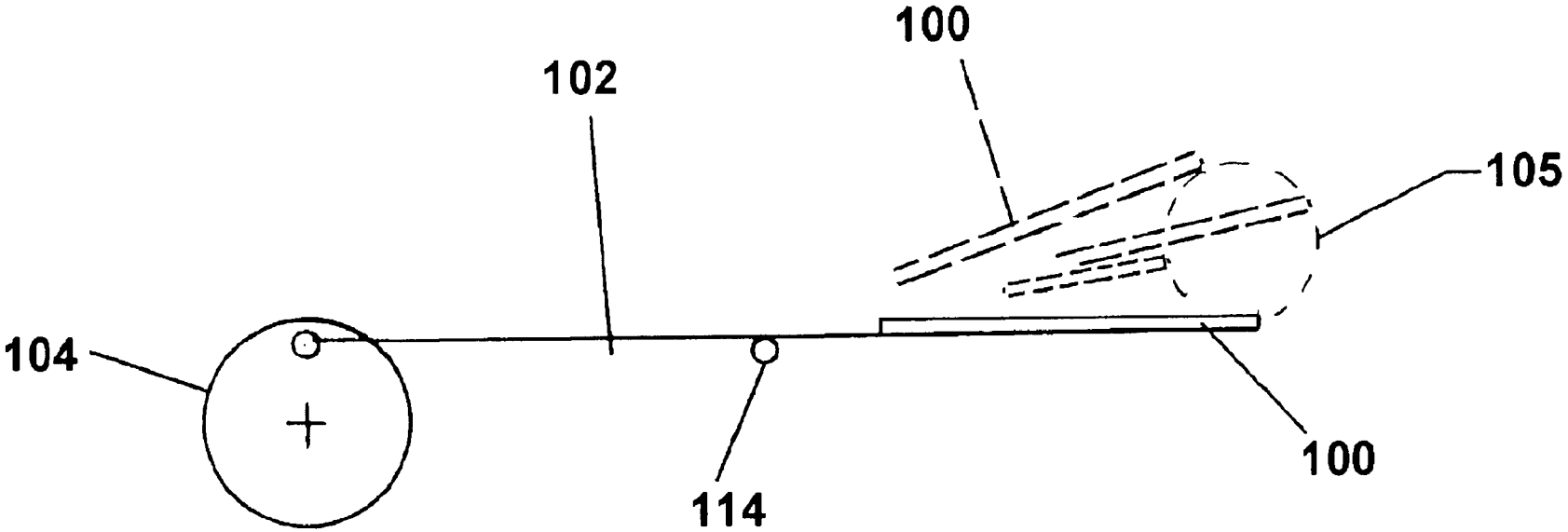
FIG. 9 is a schematic view illustrating the orbiting of the arm rest of the upper body system.

The upper body exerciser 14 includes a laterally spaced pair of armrests 100 including rearwardly extending drive arms 102. The arm rests are generally rectangular and support the forearms of the user. A roller 103 is supported at the upper front end of each armrest and provides a contoured surface for gripping by the user during the exercise cycle. The armrest 100 orbits in a circular pattern 105 in operation as indicated by the arrows in FIG. 9 to articulate the shoulder and elbow joints and to extend and elevate the upper arm of the user. Each drive arm 102 is fixedly connected at a forward end to the underside of the armrest 100, pivotally connected at a rear end to a crank disc 104 of the upper drive system, and centrally slidably supported by a guide arm assembly 106. Referring additionally to FIG. 6, the guide arm assembly includes a support arm 108 attached at a lower end to the base frame 22 and having a pair of laterally spaced guide plates 110 attached to the upper end defining an upwardly opening slot 112. A guide roller 114 is rotatably supported in the slot by pin 116 extending through the guide plates 110. The drive arm 102 rides on top the roller 114.

Figure 7:
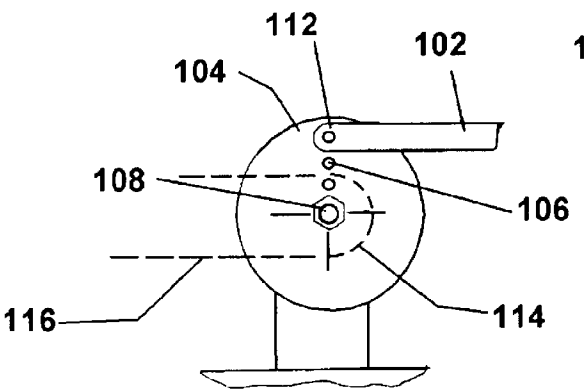
FIG. 7 is a fragmentary side view of the connection between the crank disk and the drive arm for the upper body system.
Figure 8:
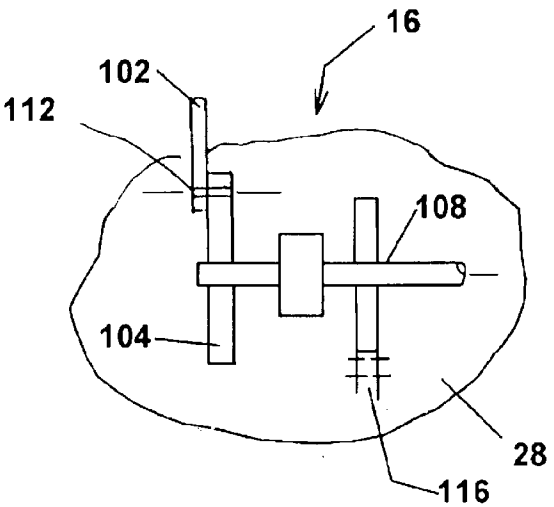
FIG. 8 is a fragmentary top view of the top drive system.

Referring to FIGS. 7, 8 and 11, the crank discs 104 are circular plates having a series of radial spaced holes 106. A crank disc 104 is rotatably connected at each outer end of a drive shaft 108 supported on bearings 110 mounted on seat frame 24. The rear ends of the drive arms 102 are pivotally connected to the crank discs 104 at one of the holes 106 at pin connection 112. An input sprocket 114 is connected at the center of the shaft 108 and drivingly connected with drive chain 116 to an output sprocket 118 connected to the output shaft of a variable speed electric motor 120. Accordingly operation of the motor 120 rotates the crank disc 104 through drive chain 116 thereby reciprocating the rear end of the drive in a circular path. Referring to the schematic of FIG. 9, this motion of the drive arm imparts an orbiting circular pattern 105 to the armrest 100 thereby moving the users forearm and upper arm in a movement sequence that exercises the muscles of the shoulder and upper arm and articulates the shoulder and elbow joints. The radial holes on the crank disc can be selected for attachment to vary the characteristics of the armrest movement.

Accordingly, it will be appreciated that the orbiting movement will articulate and exercise both the shoulder and elbow joints and associated muscles. By changing the connection, greater or lesser movements can be established in accordance with patient needs and capabilities.

The upper and lower systems are separately controlled as to speed and operation by the control unit 21. The control unit 21 is carried on an L-shaped support arm 130 that is rotatably mounted at a lower end on a bracket 132 at the front of the seat frame 28. The control unit includes a control box 134 attached to the upper end of the support arm 130. Accordingly, the control box and support arm can be swiveled to a position accessible by the user regardless of lateral disabilities. The control box 134 may also be moved to an outboard position for use by a third party.

Figure 10:
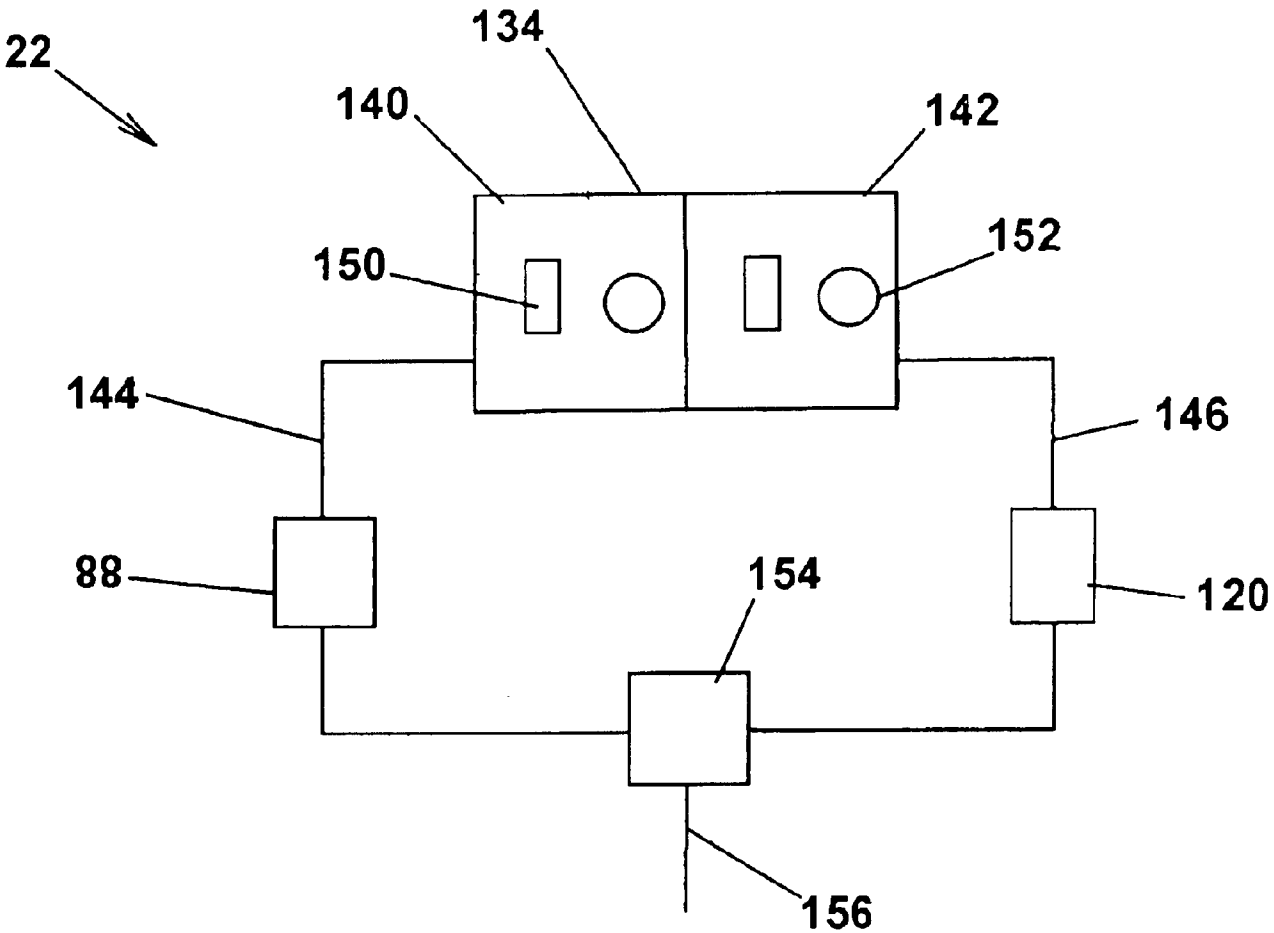
FIG. 10 is a schematic view of the control system of the motorized rehabilitation chair.

Referring to FIG. 10, the control box 134 includes separate control units 140 and 142 connected by cables 144, 146, routed along the support arm and base frame to the motors 80 and 120. Each control unit includes an on/off switch 150 and speed control knob 152 allowing the user to individually actuate a selected exercise system and regulate the speed thereof for the exercise and rehabilitation regimen undertaken. The cables are connected to an exterior junction box 154 at the side of the enclosure 40 for connection by auxiliary cable to a suitable power source.

Accordingly, a disabled user seated on the chair positions the control unit 21 for access and positions their feet on the footrest 56. A speed is selected for the exercisers desired for the exercise regimen. With a free hand the selected drive units are actuated and the hands placed on the armrests 100 and the exercising movements undertaken. If the user desires to change speeds or enable or disable a unit, the appropriate changes can be effected.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A motorized exercise and rehabilitation chair for pacing controlled movements of the legs and arms of a disabled user, comprising: a base platform; a chair including a horizontal seat cushion and a vertical seat back; adjustable support members for supporting said cushion above said base platform; a foot platform slidably supported on said base platform beneath said cushion; first drive means carried on said base platform for longitudinally moving said foot platform between a forward position and a rearward position; a footrest for supporting the feet of the user connected to the front end of said foot platform for pivotal movement about a transverse axis from a horizontal position to a forwardly and upwardly inclined position; an actuator member connected between said base frame and said footrest for moving said footrest to said inclined position as said foot platform approaches said forward position thereby flexing the knees and ankles of said user; first control means operable by said user for operating and regulating the speed of said first drive means; a pair of armrests on opposite sides of said cushion for supporting the forearms of said user; second drive means for moving said armrests a orbiting circular pattern for flexing the elbows and shoulders of said user; and second control means connected with said second drive means operable by said user for operating and regulating the speed of said second drive means.

2. The motorized exercise and rehabilitation chair as recited in claim 1 wherein said actuator member includes a biasing member applying a resistive force against the foot of the user as the footrest moves to said inclined position.

3. The motorized exercise and rehabilitation chair as recited in claim 2 wherein said biasing member is a coiled spring.

4. The motorized exercise and rehabilitation chair as recited in claim 2 wherein said first drive means includes a chain loop, a drive member operatively attached at on end to said chain loop and at the other end to said foot platform, and a motor for rotating said chain loop thereby moving said platform between said forward position and said rearward position.

5. The motorized exercise and rehabilitation chair as recited in claim 1 wherein said armrest includes a rearwardly extending arm supported at a middle section on a roller member carried above said cushion, and said second drive means includes a rotatable member eccentrically pivotally connected to a rear end of said arm for reciprocating and inclining said arm to impart said circular motion to said armrest.

6. The motorized exercise and rehabilitation chair as recited in claim 5 wherein said roller member is vertically adjustable.

7. The motorized exercise and rehabilitation chair as recited in claim 6 wherein said rotatable member is a circular disk rotatable about a transverse axis and said rear arm is pivotally connected to said disk radially outward of said transverse axis.

8. The motorized exercise and rehabilitation chair as recited in claim 7 wherein said first and second control means are mounted on a support arm pivotally mounted in front of said cushion for positional control by either hand of the user.

9. The motorized exercise and rehabilitation chair as recited in claim 8 wherein a roller is transversely rotatably supported at a forward end on said armrest for gripping by the hand of the user.

10. The motorized exercise and rehabilitation chair as recited in claim 1 wherein said adjustable members permit selective longitudinal and vertical positioning of said chair.

* * * * *